US005832344A

United States Patent [19]

Munakata

[11] Patent Number: 5,832,344

[45] Date of Patent: Nov. 3, 1998

[54] IMAGE FORMING APPARATUS HAVING IMAGE BEARING MEMBER WITH FLYWHEEL

[75] Inventor: Reo Munakata, Yokohama, Japan

[73] Assignee: Ricoh Company, Ltd., Tokyo, Japan

[21] Appl. No.: 759,475

[22] Filed: Dec. 5, 1996

[30] Foreign Application Priority Data

Dec. 5, 1995 [JP] Japan ..... 7-344608

[51] Int. Cl.[6] ..... G03G 15/00

[52] U.S. Cl. ..... 399/117; 399/167

[58] Field of Search ..... 399/117, 159, 399/167; 74/572, 574; 318/161

[56] References Cited

U.S. PATENT DOCUMENTS

| | | | |
|---|---|---|---|
| 4,935,778 | 6/1990 | Mochida | 399/167 |
| 5,371,576 | 12/1994 | Gonda | 399/167 |
| 5,420,664 | 5/1995 | Miwa et al. | 399/167 |
| 5,422,706 | 6/1995 | Tsunemi et al. | 399/159 |
| 5,528,348 | 6/1996 | Miwa et al. | 399/167 |

FOREIGN PATENT DOCUMENTS

| | | |
|---|---|---|
| 60-101262 | 7/1985 | Japan . |
| 61-19248 | 2/1986 | Japan . |
| 62-141572 | 6/1987 | Japan . |
| 63-177190 | 7/1988 | Japan . |
| 2-199464 | 8/1990 | Japan . |
| 5-72836 | 3/1993 | Japan . |

*Primary Examiner*—Robert Beatty

*Attorney, Agent, or Firm*—Oblon, Spivak, McClelland, Maier & Neustadt, P.C.

[57] ABSTRACT

In an image forming apparatus having a photoconductive member supported via two supporting members fixed on a rotation axis and a flywheel with great moment of inertia, the characteristic oscillation frequency of the revolution system comprising the rotation axis, supporting members and photoconductive member is set so that any density unevenness on a toner image which is formed on the photoconductive member is not apparent even if an exciting torque affects the photoconductive drum. The moment of inertia of a rotation axis, a photoconductive drum, and a flywheel, a torsional regidity of the rotation axis and a mounting position of a support member, and a surface speed of the photoconductive drum all satisfy a specific relationship.

7 Claims, 2 Drawing Sheets

IMAGE FORMING APPARATUS HAVING IMAGE BEARING MEMBER WITH FLYWHEEL

BACKGROUND OF THE INVENTION

1. Field of the Invention

The present invention relates to an image forming apparatus, more particularly to an image forming apparatus having a rotation axis.

2. Discussion of the Background

In an image forming machine such as a copying machine, printer, press printing machine or facsimile, density unevenness occurs when the revolution speed of an image bearing member changes during the image forming process in a sub-scanning direction. To prevent the density unevenness, a flywheel is fixed on a rotation axis which supports the image bearing member via supporting members, preventing the speed from changing even if a change in torque is generated on the image bearing member by an abrupt outside influence. (Refer to Japanese Laid Open Patent No. 63-177190 or Japanese Laid Open Patent No. 2-199464). Since, especially in color image forming apparatuses, uniformity of midrange density is strongly required, the flywheel fixed on the rotation axis is widely adopted to efficiently restrain the speed change of the image bearing member due to the outside influence.

As demand for density uniformity of images increases over time, the moment of inertia of the flywheel fixed on the rotation axis tend to increase. For example, image forming apparatuses whose moment of inertia is more than 0.5 Kg $m^2$ are sold or considered as products to be marketed.

In view of this situation, the present inventor has studied the correlation between the moment of inertia of the flywheel and the speed change of the image bearing member created by outside influences, and surprisingly concluded that the flywheel can reduce speed changes but that it is not possible to fully control the speed changes of the image bearing member simply by increasing the moment of inertia of the flywheel. The reasons will be described below.

When the moment of inertia around the central line of the rotation axis, the moment of inertia around the central line of the image bearing member and the moment of inertia around the central line of the flywheel are represented J1(kg $m^2$), J2(kg $m^2$) and J3(kg $m^2$) respectively, the flywheel functions like a fixed end for fixing and supporting the revolution system including the rotation axis if J3 is set to be greater than 5(J1+J2), that is, $J3 \geqq 5(J1+J2)$, since the moment of inertia of the flywheel is extremely great when the revolution system comprising the rotation axis, flywheel, image bearing member and supporting members rotates during image forming process. That is, the flywheel will rotate at a uniform angular velocity due to its great moment of inertia, but the image bearing member will accelerate or decelerate relative to the flywheel rotating at the uniform angular velocity when the image bearing member is subjected to an outside disturbance.

Looking at the dynamics of the rotating motion of the system including the flywheel, the image bearing member and the rotation axis may be regarded as equivalent of a beam supported at the flywheel as a fixed end.

If the image bearing member is subjected to an outside disturbance such as outside oscillation torque, torsional oscillation occurs relative to the flywheel around the rotation axis, the supporting member of the image bearing member or both of them. As a result, the speed of the image bearing member changes. If the speed of the image bearing member changes, density unevenness of an image occurs and the quality of the image deteriorates. Thus, the effect of increasing the moment of inertia of the flywheel is limited and it is impossible to completely eliminate image density unevenness in this way.

Since the flywheel functions as the fixed end of the rotation axis, torsional stress is concentrated at the root portion of the nearest supporting member to the flywheel, not at the root portions of the other supporting members when the image bearing member is subjected to torque. That is, great torsional stress is created in the rotation axis portion between a fixed portion defined by the flywheel on the rotation axis and the nearest supporting member from the flywheel and the supporting, but not in the other supporting members and the rotation axis.

SUMMARY OF THE INVENTION

It is therefore an object of the present invention to provide an image forming apparatus capable of preventing the image quality from deteriorating, in which a flywheel with a great moment of inertia is used to control speed changes in an image bearing member due to outside disturbances.

The above-mentioned and other are achieved by a image forming apparatus satisfying the following equations, wherein the moment of inertia around the central line of a rotation axis, the moment of inertia around the central axis line of a image bearing member, the moment of inertia around the central axis line of a flywheel, torsional rigidity of rotation axis portion between a fixed portion of the flywheel on the rotation axis and a fixed portion of the nearest supporting member from the flywheel on the rotation axis, torsional rigidity of supporting member which is the nearest from the flywheel, a surface speed of the image bearing member are respectively represented as J1 (Kg $m^2$), J2 (Kg $m^2$), J3 (Kg $m^2$), K1 (N m), K2 (N m) and V (m/s):

$$J3 \geqq 5(J1+J2)$$

and $$\frac{1}{2\pi} \cdot \frac{\sqrt{\{J1 \cdot K2 + J2 \cdot (K1+K2)\} - \sqrt{\{J1 \cdot K2 + J2 \cdot (K1+K2)\}^2 - 4 \cdot J1 \cdot J2 \cdot K1 \cdot K2}}}{2 \cdot J1 \cdot J2} \geqq 3000 \cdot V.$$

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
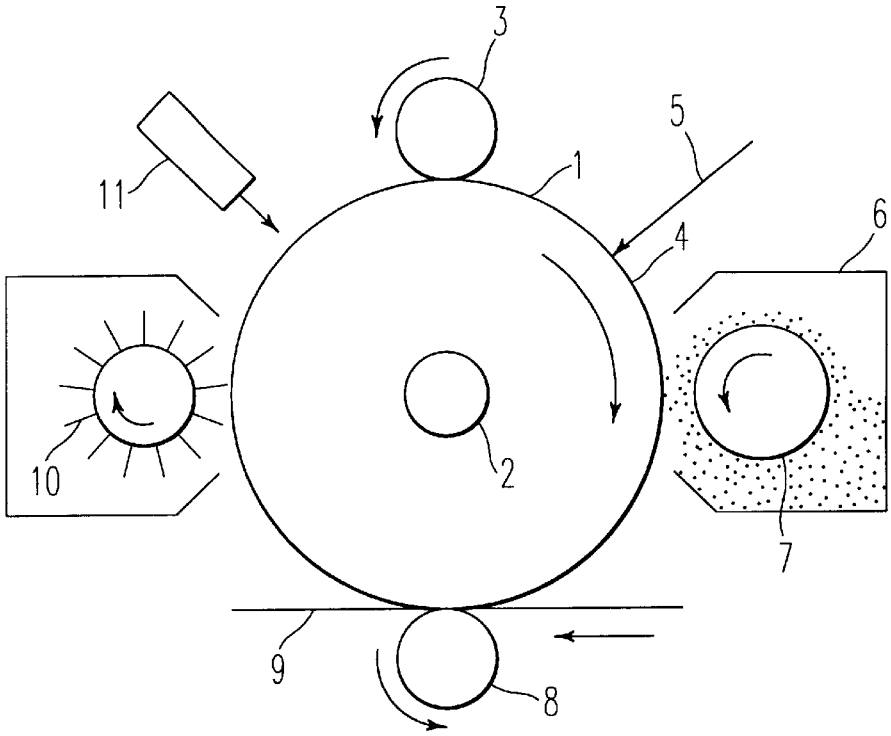
FIG. 1 is a sectional view of an image forming apparatus according to a first embodiment of the present invention.

Description of embodiments in the present invention will now be made referring to the drawings.

FIG. 1 is a sectional view of an image forming apparatus (a copying machine in this case) according to the present invention. A drum type of photoconductive member 1 which is an example of an image bearing member, as mentioned below, is fixed and supported on an rotation axis 2 via supporting members, and is rotated by the rotation axis 2, clockwise in FIG. 1. The rotating axis may be embodied by a shaft or rod.

A charging roller 3 which is an example of a charging apparatus is in contact with a surface of the photoconductive member 1, whereby the surface of the photoconductive member 1 is uniformly charged. An exposing portion 4 exposes the charged surface, for example, by a laser beam 5, so that a latent image is created on a photoconductive member 1. The latent image is developed as a toner image by a developer, which is applied to the latent image by a developing unit having a developer roller.

The toner image is transferred onto a paper sheet sent toward a transferring portion between a transferring roller 8, which is an example of a transferring apparatus, and the photoconductive member 1. After transfer, remaining toner on the photoconductive drum 1 is removed from the photoconductive member 1 by fur brush 10 of a cleaning apparatus and then an erasing apparatus 11 erases charges remaining on the photoconductive member 1. The transferred toner image 9 is fixed on the paper sheet by a fixing apparatus (not shown).

Figure 2:
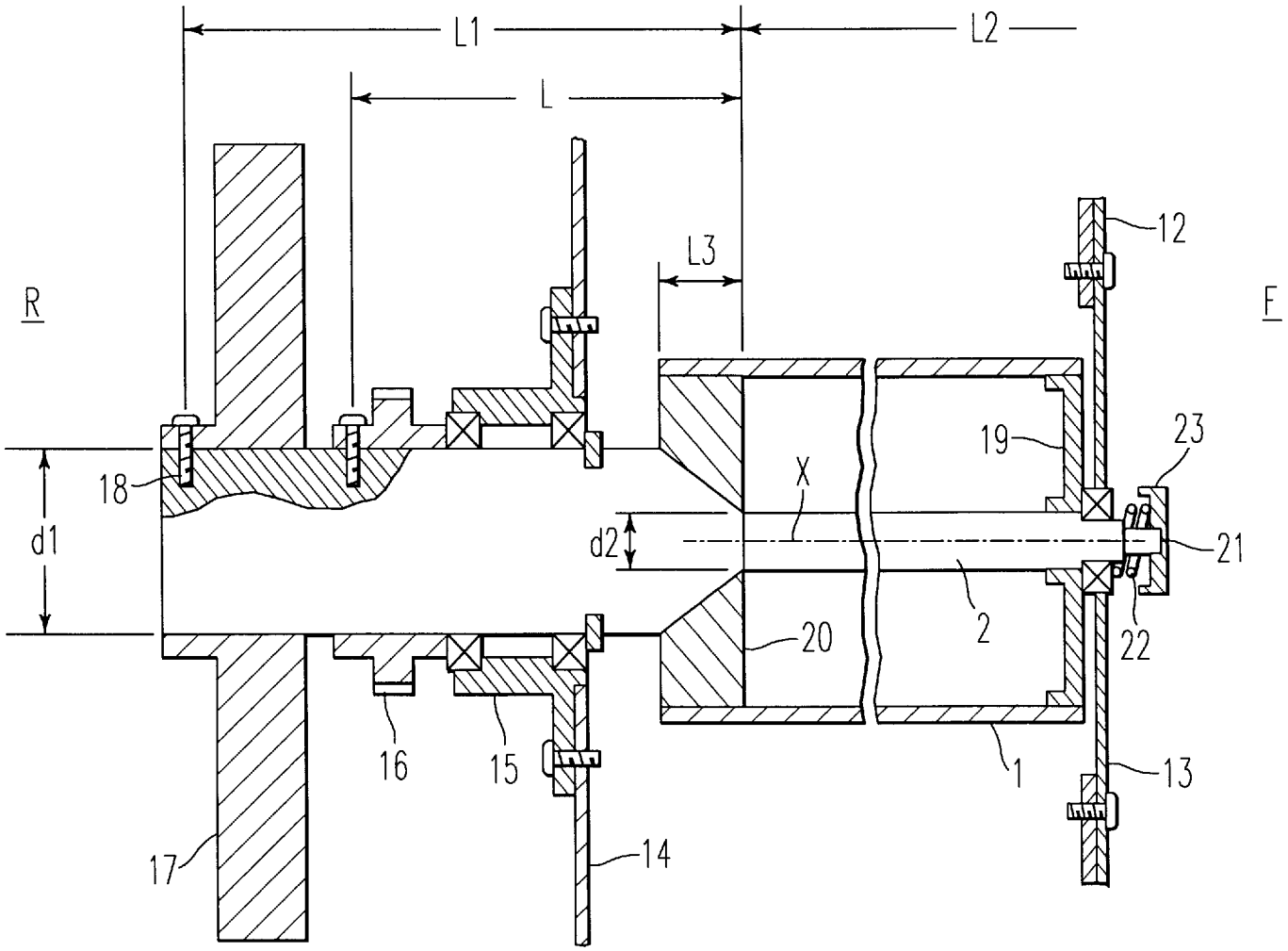
FIG. 2 is a sectional view showing a rotation axis, a photoconductive member on the rotation axis and a flywheel which is fixed on the rotation axis.

FIG. 2 is a sectional view showing the photoconductive member 1 shown in FIG. 1 and a supporting structure. A symbol F represents a front side of the copying machine where an operator is positioned to make copies and a symbol R represents a rear side of the copying machine, that is, a back side. The rotation axis extends in the front–rear direction and may take the form of a rotary shaft 2 rotatably supported via bearings by a mounting board 13 which is removably mounted on a front side board 12 and a supporter sleeve 15 which is mounted on a rear side board 14.

The front side board 12, mounting board 13 and rear side board 14 constitute a supporting frame of the image forming apparatus and the rotation axis 2 is positioned and rotatably supported on the supporting frame.

A gear 16 which is an example of a driving and transmitting member is fixed on a rotation axis portion behind the rear side board 14. The gear is driven by a driving motor (not shown) supported in the main body of the image forming apparatus via a transmitting gear (not shown). The rotation axis 2 is thereby rotated around the central axis line X.

In the back end portion of the rotation axis 2, a flywheel 17 is fixed by a fixing member such as screw 18 and is disposed so as to be concentric with the rotation axis and rotates around the central axis line X together with the rotation axis 2.

Further, a plurality of supporting members 19 and 20 (two members as an example in this figure) are provided separately from one another on a rotation axis portion between the front side board 12 and the rear side board 14 which is spaced away from the front side board 12.

These supporting members are formed in disc shapes centered on the central axis line X and are concentric with the rotation axis 2. The drum type photoconductive member 1 is fixed on these supporting member 19 and 20 and is concentric with the rotation axis 2.

When the moment of inertia around the central axis line X of the rotation axis 2, the moment of inertia around the central axis line X of the drum type photoconductive member 1, and the moment of inertia around the central axis line X of the flywheel 14 are represented as J1 (Kg $m^2$), J2 (Kg $m^2$), J3 (Kg $m^2$), the moment of inertia J3 of the flywheel 17 is set to satisfy the following equation:

$$J3 \geqq 5(J1+J2)$$

Since the flywheel with a great moment of inertia is mounted on the rotation axis 2, it is possible minimize sharp speed changes in the photoconductive member 1 even though external oscillation torques affect the photoconductive member 1 when the photoconductive member 1 rotates. That is, the rotating photoconductive member 1 may be subjected to external oscillation torques with a wide exciting frequency from the image forming elements contacting the photoconductive member 1, such as the charging roller 3, the transferring roller 8 and fur brush 10 in FIG. 1, when the photoconductive member 1 rotates. But since the flywheel 17 with a great moment of inertia is fixed on the rotation axis 2 supporting the photoconductive member 1, it is generally possible to control the speed changes in the photoconductive member and thereby reduce density unevenness of a toner image formed on the photoconductive member 1.

As mentioned before, however, it is difficult to completely prevent the speed changes of the photoconductive member 1 simply by making large the moment of inertia of the flywheel 17. Thus, there occurs a slight density unevenness on the photoconductive member 1 in a rotating direction (a sub-scanning direction).

This is because, when the moment J3 of inertia of the flywheel 17 is great such as 5(J1+J2), the flywheel is regarded as a fixed end in the revolution system including the rotation axis 2. That is, the rotation axis 2 may be regarded as a beam supported at one end by the flywheel 17. In this case, the revolution system including the rotation axis 2 causes torsional oscillation with respect to the flywheel 17 due to the external oscillation torques applied to the photoconductive member 1. Thereby, speed changes occur in the photoconductive member 1 and as a result density unevenness can occur on the toner image formed on the photoconductive member 1.

In the conventional image forming apparatus, the facts mentioned above are not taken into account. That is, when the revolution system including the rotation axis 2 is designed, the moment of the rotation axis 2, the supporting members 19 and 20 and the torsional stress are decided and set regardless of whether there is to be a flywheel provided on the rotation axis. For example, in the conventional way of designing the revolution system, only the torsional rigidity of the rotational axis portion L between the gear 16 and the supporting member 20 are taken into account so as not to generate transmission and drive problems between the gear 16 and the supporting member 20, and the strength of the supporting members 19 and 20 is set so as to withstand a stationary radial load applied to the photoconductive member 1. Such design considerations does not address the problems of a structure in which the rotation axis 2 is regarded as fixed on the flywheel 17, and it is difficult to eliminate density unevenness of images due to subtle speed changes which occur in the photoconductive member 1.

It is possible to substantially eliminate density unevenness in the image forming apparatus by the following modification.

The characteristic frequency of oscillation of the revolution system which comprises the rotation axis 2, the supporting members 19 and 20, and the photoconductive member 1 may be represented as "f". When the revolution system undergoes torsional oscillation due to the external oscillation exciting torque which affects the photoconductive member 1, the amplitude of vibration has a peak value and density unevenness in the rotating direction of the photoconductive member 1 when an exciting frequency of the exciting torque is consistent with the oscillation frequency "f". Thus, the revolution system resonates with the external torque, the photoconductive member 1 undergoes a speed change, and the density unevenness on the photoconductive member increases and image quality deteriorates. Accordingly, it is possible to prevent the image quality from deteriorating by eliminating density unevenness of images when the revolution system undergoes resonance and the photoconductive drum changes in speed.

Frequencies covering a wide area are included in the exciting frequency affecting the photoconductive member 1. On the other hand, even if density unevenness occurs in the image due to the speed change of the photoconductive member 1, it is difficult to visually distinguish the if the pitch is extremely small, that is, the deterioration of image quality cannot be recognized. In general, the density unevenness is not conspicuous and cannot be visually recognized as density unevenness if there are more than three lines of density unevenness per 1 mm width in the rotating direction of the photoconductive member 1.

When a surface speed of the photoconductive member 1 in the rotating direction and a frequency of the speed change of the photoconductive member 1 are given as V(m/s) and "$f_0$" (Hz), where "$f_0$" equals V(m/s)÷(1/3000) (m), since any density unevenness of more than this frequency cannot be visually recognized, deterioration of image quality does not substantially occur. Accordingly, by setting "$f_0$" as a threshold level so that in the revolution system resonance occurs at high frequencies, density unevenness of the images due to speed change of the photoconductive member 1 cannot be recognized by humans and the images cannot be regarded as deteriorated.

The image forming apparatus according to the present invention is based on the above mentioned discovery. When the characteristic frequency of the revolution system comprising the rotation axis 2, the supporting member 19 and 20 and the photoconductive member 1 is represented as "f", "f" is set so as to be more than the threshold frequency "$f_0$", and resonance of the revolution system will not cause image quality deterioration.

Description of the image forming apparatus according to the present invention will now be made.

As mentioned above, with the moment of inertia of the rotation axis 2, the photoconductive member 1 and flywheel 17 representing as J1, J2 and J3, the moment of inertia J3 is as great as 5(J1+J2).

As shown in FIG. 2, a rotation axis portion between the screw 18 and that of the nearest supporting member 20 to the flywheel 17 is referred as a first axis portion L1 to distinguish it from a second axis portion L2 which will be explained below. The torsional rigidity of the first axis portion L1 is represented as K1 (N·m). The torsional rigidity of the nearest supporting member 20 to the flywheel 17 is referred as K2 (N·m) and a surface speed of the photoconductive member 1 is represented as V(m/s).

The reason that the torsional rigidity K1 of the first axis portion L1 and only the torsional rigidity K2 of the supporting member 20 which is the nearest one to the flywheel 17 are focused on is that it is not necessary to take the torsional rigidity of the other rotation axis portion and the supporting member 19 into account since the rotation axis 2 may be regarded as a beam fixedly supported at the flywheel 17 and the torsional stress is concentrated at the first axis portion L1 and at the supporting member 20 which is nearer to the flywheel 19 when the exciting torque from the charging roller and the transferring roller 3, etc., affects the photoconductive member 1 supported on the rotation axis 2.

In general, since the supporting members 19 and 20 are made of light materials such as synthetic resins, the moment of inertia of the supporting members 19 and 20 is ignored.

Figure 3:
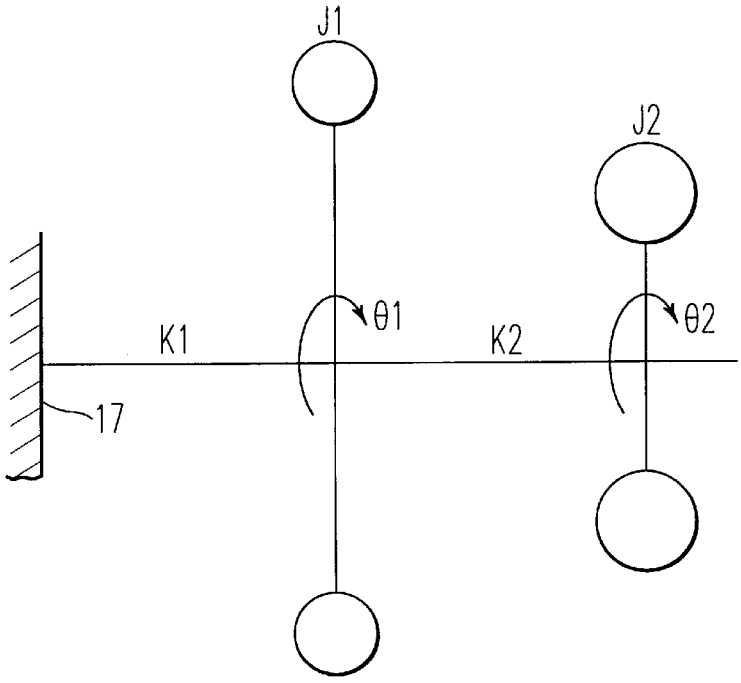
FIG. 3 is a model of revolution system comprising the rotation axis, supporting members and the photoconductive drum.

FIG. 3 is a model of the revolution system comprising the rotation axis, supporting members and the photoconductive drum. The rotation axis and the flywheel rotate together, but the rotation axis is regarded as a beam supported at one end since the moment of inertia of the flywheel 17 is extremely great. In this case, the flywheel 17 is regarded as a fixed end.

The characteristic frequency of the revolution system "f" is obtained below.

As shown in FIG. 3, when the rotation axis 2 undergoes torsional deflection by an angle θ1, and the supporting member 20 undergoes torsional deflection by an angle θ2, the equations 2 and 3 of motion are shown below.

Equation 2

$$J1 \cdot \frac{d^2\theta 1}{dt^2} = -K1 \cdot \theta 1 - K2(\theta 1 - \theta 2)$$

Equation 3

$$J2 \cdot \frac{d^2\theta 2}{dt^2} = -K2(\theta 2 - \theta 1)$$

where "$d^2\theta 1/dt^2$" and "$d^2\theta 2/dt^2$" represent angular acceleration, each of which is obtained by differentiating the angles θ1 and θ2 twice.

Equation 2 is a relative equation of torque affecting the rotation axis 2 and the equation 3 is a relative equation of torque affecting the supporting member 20. When the frequency of characteristic angular oscillation and fixed numbers are represented as ω, β1 and β2 respectively, θ1 and θ2 are represented by the following equations 4 and 5.

Equation 4

$$\theta 1 = \beta 1 \cdot e^{j\omega t}$$

Equation 5

$$\theta 2 = \beta 2 \cdot e^{j\omega t}$$

And further the following Equations 6 and 7 are obtained:

Equation 6

$$\frac{d\theta 1}{dt} = \beta 1 \cdot j \cdot \omega \cdot e^{j\omega t}$$

Equation 7

$$\frac{d\theta 2}{dt} = \beta 2 \cdot j \cdot \omega \cdot e^{j\omega t}$$

Based on the equations 6 and 7, the following equations 8 and 9 are obtained.

Equation 8

$$\frac{d^2\theta 1}{dt^2} = \beta 1 \cdot j^2 \cdot \omega^2 \cdot e^{j\omega t} = -\beta 1 \cdot \omega^2 \cdot e^{j\omega t} = -\omega^2 \cdot \theta 1$$

Equation 9

$$\frac{d^2\theta 2}{dt^2} = \beta 2 \cdot j^2 \cdot \omega^2 \cdot e^{j\omega t} = -\beta 2 \cdot \omega^2 \cdot e^{j\omega t} = -\omega^2 \cdot \theta 2$$

The following equation 10 is obtained by substituting the equation 8 into the equation 2.

Equation 10

$$-\omega^2 \cdot J1 \cdot \theta 1 = -K1 \cdot \theta 1 - K2(\theta 1 - \theta 2)$$

$$\omega^2 \cdot J1 \cdot \theta 1 = K1 \cdot \theta 1 + K2(\theta 1 - \theta 2) = (K1 + K2)\theta 1 - K2 \cdot \theta 2$$

-continued $$\therefore \{\omega^2 \cdot J1 - (K1 + K2)\}\theta 1 = -K2 \cdot \theta 2$$

$$\therefore \frac{\theta 2}{\theta 1} = -\frac{\{\omega^2 \cdot J1(K1 + K2)\}}{K2}$$

The following equation 11 is obtained by substituting the equation 9 into the equation 3:

$$-\omega^2 \cdot J2 \cdot \theta 2 = -K2(\theta 2 - \theta 1)$$

$$\omega^2 \cdot J2 \cdot \theta 2 = K2(\theta 2 - \theta 1)$$

$$\therefore (\omega^2 \cdot J2 - K2)\theta 2 = -K2 \cdot \theta 1$$

-continued $$\therefore \frac{\theta 2}{\theta 1} = -\frac{K2}{\omega^2 \cdot J2 - K2}$$

Based on the equations 10 and 11, the following equations are obtained:

$$\frac{\omega^2 \cdot J1 - (K1 + K2)}{K2} = \frac{K2}{\omega^2 \cdot J2 - K2}$$

$$\therefore \{\omega^2 \cdot J1 - (K1 + K2)\}(\omega^2 \cdot J2 - K2) = K2^2$$

$$\therefore \omega^4 \cdot J1 \cdot J2 - K2 \cdot \omega^2 \cdot J1 - (K1 + K2)\omega^2 \cdot J2 + K2(K1 + K2) = K2^2$$

If $p=\omega^2$, the following equation is obtained:

$$J1 \cdot J2 \cdot \omega^4 - [J1 \cdot K2 + J2(K1 + K2)]\omega^2 + K1 \cdot K2 = 0$$

Equation 13

$$J1 \cdot J2\, p^2 - [J1 \cdot K2 + J2(K1 + K2)]p + K1 \cdot K2 = 0$$

Since the equation 13 is a quadratic equation, two solutions exist, but if the lesser solution is selected, p is shown in the equation 14.

Equation 14

$$p = \frac{\{J1 \cdot K2 \cdot + J2 \cdot (K1 + K2)\} - \sqrt{\{J1 \cdot K2 \cdot + J2 \cdot (K1 + K2)\}^2 - 4 \cdot J1 \cdot J2 \cdot K1 \cdot K2}}{2 \cdot J1 \cdot J2}$$

On the other hand, the following equation 15 is as shown below when $f=\omega/2$.

Equation 15

$$f = \frac{1}{2\pi} \cdot \frac{\sqrt{\{J1 \cdot K2 + J2 \cdot (K1 + K2)\} - \sqrt{\{J1 \cdot K2 + J2 \cdot (K1 + K2)\}^2 - 4 \cdot J1 \cdot J2 \cdot K1 \cdot K2}}}{2 \cdot J1 \cdot J2}$$

This is the characteristic oscillation frequency "f" of the revolution system.

The lowest speed change frequency of the photoconductive member 1 which cannot be recognized by human eyes is shown in the following equation 16:

Equation 16

$$f_0 = V(m/s) \div (1/3000)\,(m) = 3000\ V(Hz)$$

If the characteristic oscillation frequency "f" shown in the equation 15 is more than an allowable frequency $f_0$, it is possible to prevent density unevenness of images from being recognized by human eyes even if the revolution system resonates.

Equation 17

$$\frac{1}{2\pi} \cdot \frac{\sqrt{\{J1 \cdot K2 + J2 \cdot (K1 + K2)\} - \sqrt{\{J1 \cdot K2 + J2 \cdot (K1 + K2)\}^2 - 4 \cdot J1 \cdot J2 \cdot K1 \cdot K2}}}{2 \cdot J1 \cdot J2} \geqq 3000 \cdot V$$

If the equation 17 is satisfied, it is possible to substantially prevent noticeable density unevenness in images on the photoconductive member 1.

The reason that only the lesser solution of the equation 13 is adopted is to prevent visible density unevenness of images when resonance occurs in the revolution system by setting the lower characteristic oscillation to be more than $f_0$=3000 (V). Since the higher characteristic oscillation frequency is more than $f_0$, density is not noticeable and high quality images can be expected when resonance occurs in the revolution system due to an exciting torque of an exciting frequency which is consistent with the characteristic number of the lower frequency.

When the rotation axis 2 is made to satisfy the equation 17, the outer diameter is greater than that of the conventional image forming apparatus. However, a portion of the rotation axis 2 relating to torsional rigidity K1, which is one of the primary factors to satisfy the condition in the equation 17, is only the first axis portion L1. Accordingly it is sufficient if the outer diameter of the first axis portion is made to be great.

As shown in FIG. 2, an axis portion at a side further away from the flywheel 17 than the first axis portion L1 is referred to as a second axis portion L2. An outer diameter d2 of the second axis portion L2 is set to be smaller than the outer diameter d1 of the first axis portion L1. This is because if the diameter of the rotation axis 2 were to be great along its entire length, the weight of the rotation axis 2 would be extremely big and the weight of the image forming apparatus would be great. Since the moment of inertia of the rotation axis J1 would be great, the characteristic oscillation frequency "f" would become small. Accordingly, it would be difficult to set the characteristic oscillation frequency "f" to satisfy f=3000 V. So flexibility of design of the revolution system would be narrow. Since the diameter d2 of the second axis portion L2 is made to be small, it is possible to avoid the above-mentioned problem.

As shown in FIG. 2, the outer diameter of the first axis portion L1 is tapered so as to be greater toward the flywheel 17 in a tapered axis portion L3 which is in the vicinity of the second axis portion L2. The supporting member 20 which is the nearest to the flywheel 17 is inserted and fixed in the tapered portion L3. In this structure, since the outer diameter d1 of the first axis portion L1 is much larger than the diameter d2 of the second axis portion L2, it is possible to prevent stress concentrations in the boundary portion between the first and second axis portion L1 and L2 from being a problem and to adequately concentrically mount the image bearing member.

In the image forming apparatus as shown in FIG. 2, it is possible to remove the mounting board 13 from the front side board 12 and pull the photoconductive member 1 out together with the supporting members 19 and 20, so that the photoconductive member 1 can be removed from the rotation axis 2. By a reverse procedure, the photoconductive member 1 can be mounted on the rotation axis 2. Since the taper portion L3 is formed on the rotation axis 2 and the supporting member 20 is formed with a tapered hole, the photoconductive member 1 can be concentrically positioned on the rotation axis 2 when the supporting member 20 is inserted onto the rotation axis 2 by pushing the photoconductive member 1 rearwardly until the sides of the tapered hole rest against the tapered portion L3.

In the image forming apparatus as shown in FIG. 2, a screw portion 21 is formed at the end portion in the front side of the rotation axis 2, around which a compression spring 22 is wounded and on which a pressing member 23 is screwed. The compressed spring 22 is positioned between the pressing member 23 and the mounting board 13 or the bearing in which the rotation axis 2 is inserted, so that the taper portion of the rotation axis 2 is pressed against the supporting member 20. In this way, the photoconductive member 1 is held securely to the rotation axis 2. By removing the pressing member 23 from the screw portion 21 and releasing the mounting board 13 from the front side board 12, the photoconductive member 1 may be pulled off of the rotation axis 2, the photoconductive member 1 may be reverse mounted on the rotation axis 2.

As mentioned above, it is possible to easily set and remove the photoconductive member 1 on the rotation axis 2 mounting it via a pressing means comprising, for example, the pressing member 23 screwed into the screw portion 21 of the rotation axis 2 and the compression spring 22.

In the example mentioned above, the drum type photoconductive member 1 is described as an image bearing member, but an image forming apparatus having a dielectric drum type of image bearing member can be in for the present invention. Further, an image forming apparatus having a dielectric belt or photoconductive type of image bearing member which is wound around rollers and driven by the roller, or a printer having a printing drum to perform printing operations by winding stencil paper with holes around the drum can be adopted in the present invention.

This application is based on Japanese Patent Application JP 7-344608, filed with the Japanese Patent Office on Dec. 5, 1995, the entire contents of which are hereby incorporated by reference.

Obviously, numerous modifications and variations of the present invention are possible in light of the above teachings. It is therefore to be understood that within the scope of the appended claims, the invention may be practiced otherwise than as specifically described herein.

What is claimed as new and desired be secured by Letters Patent of the United States is:

1. An image forming apparatus comprising:

a supporting frame;

a rotation axis rotatably supported on the supporting frame;

a flywheel mounted on a flywheel fixing portion of said rotation axis;

an image bearing member concentrically mounted around said rotation axis by at least a supporting member which is nearest to said flywheel;

wherein, when a moment of inertia of said rotation axis, a moment of inertia of said image bearing member, a moment of inertia of said flywheel, a torsional rigidity of a first rotation axis portion of said rotation axis located between said fixing portion and a mounting position of said supporting member which is nearest to said flywheel, a torsional rigidity of said supporting member which is nearest to said flywheel, and a surface speed of said image bearing member are represented as J1 (Kg m$^2$), J2 (Kg m$^2$), J3 (Kg m$^2$), K1 (N m), K2 (N m) and V (m/s), respectively, $$J3 \geqq 5(J1+J2),$$

and $$\frac{1}{2\pi} \cdot \frac{\sqrt{\{J1 \cdot K2 + J2 \cdot (K1+K2)\} - \sqrt{\{J1 \cdot K2 + J2 \cdot (K1+K2)\}^2 - 4 \cdot J1 \cdot J2 \cdot K1 \cdot K2}}}{2 \cdot J1 \cdot J2} \geqq 3000 \cdot V.$$

2. The image forming apparatus of claim 1 wherein said image forming member comprises a drum type image forming member.

3. The image forming apparatus of claim 1 wherein said at least a supporting member which is nearest to said flywheel comprises plural supporting members spaced along the length of said rotation axis.

4. The image forming apparatus of claim 3 wherein said rotation axis also has a second axis portion farther away from said flywheel than is said first rotation axis portion, wherein an outer diameter of said second rotation axis portion is smaller than an outer diameter of said first rotation axis portion.

5. The image forming apparatus of claim 4 wherein said first rotation axis portion merges with said second rotation axis portion at a taper portion, an outer diameter of said taper portion increasing toward said flywheel, said nearest supporting member to said flywheel being mounted at said taper portion.

6. The image forming apparatus of claim 1 including pressing means for pressing said nearest supporting member onto said taper portion.

7. The image forming apparatus of claim 6 wherein said pressing means includes a pressing member mounted on an end of said rotation axis opposite said flywheel and a spring mounted to said rotation axis and biasing said pressing member in a direction pressing said nearest supporting member onto said taper portion.

* * * * *